US005586397A

United States Patent [19]

Kerttula et al.

[11] Patent Number: 5,586,397

[45] Date of Patent: Dec. 24, 1996

[54] DRYER SECTIONS OF A PAPER MACHINE

[75] Inventors: Reima Kerttula; Jouko Yli-Kauppila, both of Muurame, Finland

[73] Assignee: Valmet Corporation, Helsinki, Finland

[21] Appl. No.: 229,471

[22] Filed: Apr. 18, 1994

[30] Foreign Application Priority Data

Nov. 30, 1993 [FI] Finland ..... 935340

[51] Int. Cl.[6] ..... F26B 3/00

[52] U.S. Cl. ..... 34/114; 34/118; 34/117

[58] Field of Search ..... 34/114, 115, 116, 34/117, 118

[56] References Cited

U.S. PATENT DOCUMENTS

| | | | |
|---|---|---|---|
| 3,753,298 | 8/1973 | Ely | 34/116 |
| 3,868,780 | 3/1975 | Soininen et al. | 34/116 |
| 4,202,113 | 5/1980 | Kankaanpaa | 34/23 |
| 4,441,263 | 4/1984 | Vedenpaa | 34/115 |

(List continued on next page.)

FOREIGN PATENT DOCUMENTS

| | | |
|---|---|---|
| 70275 | 12/1985 | Finland . |
| 81856 | 8/1990 | Finland . |
| 906216 | 12/1990 | Finland . |
| 901803 | 3/1991 | Finland . |
| 56040 | 8/1993 | Japan . |
| 8806204 | 8/1988 | WIPO . |
| 8806205 | 8/1988 | WIPO . |

OTHER PUBLICATIONS

S. Palazzolo "No–Draw Drying" Tappi Journal, Sep. 1990, pp. 225–228

W. Leitenberger "Die Contirum–Trockenpartie Fur Schnellen, Sicheren Bahnlauf" Das Papier, Heft 6, 1992.

W. Haessner: "Trocknungstecnik Und Deren Entwicklung"; Das Papier 44, 10A, 1990.

"The Valmet Sym–Run Concept" Paper Asia May/Jun. 1992, pp. 38–42.

J–Yli–Kauppila: "Dryer Section For High Speed Paper Machines: Proceedings of the Helsinki Symposium of alternate methods of pulp and paper drying", Helsinki Jun. 4–7, 1991, pp. 49–60.

V. Korhonen and A. Kuhasalo: "Ropeless Tail Treading From Press To Reel", World Pulp & Paper Technology 1993.

H. Lespisto Und P. Eskelinen: "Verbesserung Der Lauffahigkeit Schneller Papiermaschinen Mit Hilfe Neuer Ventilationseinrichtungen" Das Paper 1985, Heft 10A.

Lingberg Juppi, Eskelinen: "High Speed Dryer Section Developments For Sheet Stability" 78th Annual Meeting, Technical Section CPPA 1992.

*Primary Examiner*—Henry A. Bennett
*Assistant Examiner*—Steve Gravini
*Attorney, Agent, or Firm*—Steinberg, Raskin & Davidson, P.C.

[57] ABSTRACT

A method and device for drying a paper web in a dryer section having a number of successive dryer groups with a single-wire draw, and being situated after a press section of the paper machine. Each dryer group includes contact-drying cylinders arranged in a first row and reversing suction cylinders or equivalent suction rolls arranged in a second row, the rows being horizontal, diagonal or vertical rows. The paper web is dried by contact-drying cylinders from the side of its lower face across the entire length of the dryer section. The paper web is passed as a closed draw from one dryer group to the next group, and the paper web is guided, while it runs on the drying wire at the side of the outside curve, by the reversing suction cylinders having a curve radius selected in a range from about 250 mm to about 1000 mm. The paper web is kept in constant contact with the drying wire as it is placed at the side of the outside curve, against the effect of centrifugal forces by a pressure difference which preferably extends over the entire inner circumference of the reversing suction cylinders. In addition to the above, or as an alternative, the paper web is dried from the side of its upper face on a draw or draws of the paper web that is/are free from the wire and/or a flow of drying air is applied to the upper face of the paper web through the drying wire and/or on the draws of the paper web that are free from the wire.

35 Claims, 3 Drawing Sheets

U.S. PATENT DOCUMENTS

| | | | |
|---|---|---|---|
| 4,502,231 | 3/1985 | Fissman et al. | 34/114 |
| 4,516,330 | 5/1985 | Eskelinen et al. | 34/23 |
| 4,602,439 | 7/1986 | Eskelinen et al. | 34/23 |
| 4,625,430 | 12/1986 | Aula et al. | 34/13 |
| 4,661,198 | 4/1987 | Simmonds, Jr. et al. | 156/578 |
| 4,905,380 | 3/1990 | Eskelinen et al. | 34/23 |
| 4,972,608 | 11/1990 | Ilvespaa | 34/115 |
| 4,982,513 | 1/1991 | Loser et al. | 34/116 |
| 5,022,163 | 6/1991 | Ilvespaa et al. | 34/23 |
| 5,065,529 | 11/1991 | Skaugen et al. | 34/117 |
| 5,146,696 | 9/1992 | Mayer et al. | 34/117 |
| 5,177,880 | 6/1993 | Presetanz et al. | 34/117 |
| 5,299,363 | 4/1994 | Kraft et al. | 34/117 |

DRYER SECTIONS OF A PAPER MACHINE

FIELD OF THE INVENTION

The present invention relates to dryer sections in paper machines, comprising a number of successive so-called normal groups with a single-wire draw in which contact-drying cylinders are arranged in the upper row and/or the reversing suction cylinders are arranged in the lower row and/or in equivalent diagonal or vertical rows. Between the normal drying groups, the paper web to be dried has closed group-gap draws. The reversing suction cylinders are arranged so that at least their outer circumferences covered by the paper web are subjected to negative pressure, i.e., suction.

BACKGROUND OF THE INVENTION

In the prior art, in multi-cylinder dryers of paper machines, twin-wire draw and/or single-wire draw is/are employed. In a twin-wire draw, the groups of drying cylinders include two wires which press the web, one from above and the other one from below, against the heated cylinder faces. Between the rows of drying cylinders, which are usually horizontal rows, the web has free and unsupported draws. The free draws are susceptible of fluttering which may cause web breaks, in particular since the web is still relatively moist and, therefore, has a relatively low strength. For this reason, in recent years, increasing use has been made of a single-wire draw in which each group of drying cylinders has only one drying wire. The web runs on support of the drying wire through the entire group so that the drying wire presses the web on the drying cylinders against the heated cylinder faces, and whereas, on the reversing cylinders or rolls arranged between the drying cylinders, the web remains at the side of the outside curve. Thus, in a single-wire draw, the drying cylinders are placed outside the wire loop and the reversing cylinders or rolls are situated inside the drying wire loop.

In prior art normal groups having a single-wire draw, the heated drying cylinders are typically arranged in the upper row and the reversing cylinders are therefore arranged in the lower row. The upper row and lower row are generally horizontal and parallel to one another. The assignee's Finnish Patent No. 54,627 (corresponding to U.S. Pat. No. 4,202,113, the specification of which is hereby incorporated by reference herein) describes an arrangement wherein normal groups having a single-wire draw and so-called inverted groups having a single-wire draw are arranged one after the other. In the inverted groups, the heated drying cylinders are arranged in the lower row and the reversing suction cylinders or rolls are arranged in the upper row. This arrangement enables a principle objective to be achieved, i.e., to dry the web symmetrically from both of its sides.

With respect to additional prior art, reference is made to published International Patent Applications WO 88106204 and WO 88106205 (assigned to Beloit Corp.) which describe dryer sections having normal and inverted cylinder groups.

Accordingly, in the following descriptions, the terms "normal (drying) group" and "inverted (drying) group" are used to denote the cylinder groups having a single-wire draw as described above, as such is accepted terminology to those skilled in the art.

In dryer sections that comprise inverted and normal drying groups, various problems have occurred. The present invention is directed toward a resolution of these problems.

For example, problems have been encountered in the runnability of the dryer section and in the threading of the web, problems arising from differences in the speeds of different wires, problems in the removal of broke especially in inverted groups, as well as problems related to the control of transverse shrinkage of the web. These problems tend to become worse as the running speed of the paper machine becomes higher.

With respect to prior art involved in and related to the present invention, reference is made to the following patent publications and articles published in journals:

W. Haessner, "Trocknungstechnik und deren Entwicklung"; Das Papier 44, 10A, 1990;

"The Valmet Sym-Run Concept", Paper Asia, May/Jun 1992;

J. Yli-Kauppita, "Dryer Section for High Speed Paper Machines", Proceedings of the Helsinki Symposium of Alternate Methods of Pulp and Paper Drying, Helsinki June 4–7, 1991;

Sam Palazzolo, "No-draw drying", Tappi Journal, September 1990;

W. Leitenberger, "Die Contirun-Trockenpartie fur schnellen, sicheren Bahnlauf", Das Papier, Heft 6, 1992;

U.S. Pat. Nos. 3,753,298, 3,868,780, 4,602,439, 4,972,608, 4,982,513, 5,022,163, 5,065,529, 5,146,696, and 5,177,880;

V. Korhonen and A. Kuhasalo, "Ropeless tail threading from press to reel", World Pulp & Paper Technology 1993;

H. Lepisto und P. Eskelinen, "Verbesserung der Lauffahighkeit schneller Papiermaschinen mit Hilfe neuer Ventilationseinrichtungen", Das Papier 1985, Heft 10A;

Lindberg, Juppi, Eskelinen, "High Speed Dryer Section Developments for Sheet Stability", 78th Annual Meeting, Technical Section CPPA, 1992.

With respect to the prior art closely related to the invention, reference is further made to the assignee's Finnish Patent Application No. 906216 (corresponding to U.S. patent application Ser. No. 07/808,161, the specification of which is hereby incorporated by reference herein), in which a method is described for drying a web in the dryer section of a paper machine, in particular for reducing the tendency of curling of the paper web. In the method described in FI '216, the paper web is dried on drying cylinders, against whose heated faces the paper web is pressed by means of a drying wire. In the dryer section, groups of drying cylinders are used, in which twin-wire draw and/or single-wire draw is/are applied. In this method, it has been considered novel that, in the dryer section, hot water steam is fed substantially onto the entire width of the paper web. By means of this steam, tensions that have been formed or that tend to be formed in the fiber mesh in the paper web are relaxed by means of heat and moisture in the area of their formation or substantially immediately thereafter.

Further, in FI 906216, a dryer section of a paper machine is described, intended for carrying out the above method, and which comprises one or preferably several successive drying groups which consist of drying cylinders and wire guide rolls and/or reversing cylinders. In the dryer section, a single-wire draw and/or a twin-wire draw is/are applied. In this dryer section, it has been considered novel that at least one, and preferably several, steam supply box is arranged in the dryer section and extends substantially across the entire transverse width of the paper web to be steam-treated. The steam box communicates with a steam source, and the steam box comprises a counter-face which, together with the free face of the paper web that runs at its proximity, forms a contact-free steam-treatment gap.

Further, it is known in the prior art, in a dryer section, to use devices for regulating the transverse moisture profile, such as infrared and/or moistening devices. In the prior art, by means of these devices, attempts have not been made to control the moisture profile of the paper in the z-direction, i.e., in the direction of thickness, but they are used exclusively for the control of the transverse moisture profile of the web. Further, in SC paper machines ("SC" stands for Super-Calendered), a procedure is known from the prior art in which the paper web is dried to an excessive dryness in order to obtain a sufficiently good moisture profile, whereupon the paper web is re-moistened to a moisture content optimal in view of the calendaring process. Thus, the function of these moistening devices is merely to increase the ultimate moisture content of the paper, and not to equalize its moisture profile in the z-direction.

In the prior art, a dryer section is known which is exclusively composed of the above drying groups with a single-wire draw. In these groups, between the contact-drying cylinders placed in the upper rows in the groups, normal small diameter suction rolls that are provided with inside (internal) suction boxes have been used. One particular prior art dryer section of interest in a dryer section supplied by, e.g., J. M. Voith GmbH, and situated at PM 1, Stora Feidmuehle, Reisholz, Duesseldorf, Germany.

A drawback of these small diameter suction rolls is the high requirement of negative pressure and suction energy, because, owing to the small diameter of these rolls, high centrifugal forces arise on these rolls which tend to separate the web from the drying wire. By means of the curve sectors of small radius, the suction rolls also produce a rather large relative difference in speed between the drying wire and the web, which is in many respects unfavorable. Further drawbacks include the wear of the seals at the suction box inside the suction rolls and the repeated requirement of servicing of these seals as well as the high noise level. This prior art dryer section has also required development in the respect that, since in all the groups with single-wire draw, the drying effect is applied on the contact-drying cylinders to only one side of the web, i.e., to the lower side of the web, and therefore the web tends to be dried asymmetrically in the z-direction. To an even greater extent, the web is dried at the web side placed in contact with the faces of the contact-drying cylinders. Thus, one object of the present invention is to suggest novel solutions for these problems.

In the following description, problems and requirements of the further advanced development of the prior art dryer sections, e.g., such as those attended to by the patents and papers mentioned above, will be discussed in greater detail. As background information, it should be stated that the highest web speeds of paper machines are currently already about 25 m/s (meters per second). However, in the near future, the range of web speeds will be from about 25 m/s to about 40 m/s in future paper machines. In this case, the dryer section of a paper machine will constitute a bottleneck for the runnability of a paper machine to an increasing extent. Moreover, with the use of the prior art dryer concepts, the dryer section will become quite long.

In the inverted drying groups mentioned above, in the case of web breaks, a problem arises in the removal of broke since inverted groups are not self-cleaning by the force of gravity.

The above problems and some other problems are emphasized further if, in the dryer groups with a single-wire draw, small-diameter suction rolls proper are used that are provided with an inside suction box. In order to eliminate this problem, in some machines, it has been even necessary to open some group gaps and to lower the level of negative pressure in the suction rolls.

OBJECTS AND SUMMARY OF THE INVENTION

It is an object of the present invention to provide a dryer section in which inverted groups are not needed, but which still meets the other requirements that are imposed on the dryer section.

It is a further object of the present invention to provide dryer sections whose runnability can be brought to a particularly high level.

Further, it is an object of the present invention to provide dryer sections in which so-called ropeless tail threading can be applied favorably across the entire length of the dryer section in the machine direction. Ropeless tail threading contributes to simpler dryer section construction and to shorter standstill times.

It is another important object of the present invention to provide a dryer section whose length in the machine direction can be made at least to some extent shorter, whereby the cost of investment of the paper machine and of the paper machine hall can be lowered.

It is still another particular object of the present invention to provide a dryer section after which the paper that has been dried has a sufficiently symmetric moisture profile in the z-direction, in view of the purpose of use and the other properties of the paper.

Still further, it is an object of the present invention to provide a dryer section in which it is possible to control the transverse curling and/or moisture profile of the paper web and by whose means any tensions that have arisen or tend to arise in the fiber mesh in the paper web can be relaxed by means of heat and/or moisture.

In view of achieving the objects stated above, those that will come out later, and others, in a first embodiment of the dryer section in accordance with the invention, the dryer section is substantially comprised of normal drying groups with a single-wire draw, in which reversing suction cylinders are arranged in a horizontal row or in equivalent vertical and/or diagonal rows. The suction cylinders have a perforated and grooved outer mantle which is arranged to be subjected to negative pressure without inside suction boxes in the reversing suction cylinders. The diameter D of the reversing suction cylinders is preferably selected in the range from about 500 mm to about 2000 mm, preferably in the range from about 1000 mm to about 1600 mm. The diameter (D) range of from about 500 mm to about 1200 mm is generally employed in the invention in narrower paper machines only.

The scope of the first embodiment of the dryer section in accordance with the invention also includes such embodiments in which some of the reversing suction cylinders are substituted for by so-called normal suction rolls, whose diameter is typically in the range of from about 500 mm to about 1200 mm in machines of full width. These suction cylinders are provided with an inside suction box whose suction sector generally extends over the turning sector of the paper web.

In the second embodiment of the dryer section in accordance with the invention, the dryer section is comprising primarily of normal drying groups with a single-wire draw in which drying-radiation devices and/or means for blowing of drying gas are arranged on one or more of the drying cylinders, to operate in connection with an upper face of the paper web free from the drying wire. The drying-radiation devices and/or blow means for blowing of drying gas apply a substantial drying impulse to the upper face of the paper web so as to equalize the drying profile of the paper web in the z-direction and increase the drying capacity of the dryer section.

In the second embodiment of the invention, the upper face of the paper web that is free from the drying wire can be arranged favorably in the area of a group gap or group gaps between wire groups and/or in the interior of wire groups. In particular, in locations where the drying wire is separated from the drying cylinder and from the paper web by means of a guide roll and is passed back onto the paper web, preferably on the same drying cylinder.

In the invention, since the dryer section of the paper machine is exclusively composed of so-called normal groups with a single-wire draw in which the contact-drying cylinders are placed in the upper row and the reversing suction cylinders or rolls are arranged in the lower row, and so-called inverted groups are not preferably used, the removal of broke can be made simple and free of problems across the entire length of the dryer section. With this arrangement, it is possible to employ the reliable removal of broke by means of gravity, because all the so-called normal groups in the dryer section are open downwards. Moreover, in the invention, it is advantageously possible to use ropeless tail threading across the entire length of the dryer section, which simplifies the construction of the dryer section to a considerable extent. In view of facilitating the removal of broke and the tail threading, the above devices that equalize the moisture of the paper web in the z-direction can, if necessary, be shifted further apart from the paper web.

In the so-called normal groups in accordance with the first embodiment of the invention, in the lower rows, the reversing cylinder that is used is expressly a reversing cylinder having a relatively large diameter and which is provided with a perforated mantle and an outside grooved face. The reversing cylinder does not have a suction box in its interior. The reversing cylinder is preferably the reversing suction cylinder marketed by the assignee under the trade mark "VAC-ROLL"™, an exemplifying embodiment of whose construction is described in the assignee's Finnish Patent No. 83,680 (corresponding to U.S. Pat. No. 5,022,163, the specification of which is hereby incorporated by reference herein). By the use of such reversing suction cylinders or equivalent, it is ensured that the paper web is reliably in contact with the drying wire across the entire length and width of the dryer section, so that transverse and longitudinal drying shrinkage of the paper web is substantially prevented. Moreover, the properties of quality of the paper that is being manufactured are improved.

In a second embodiment of the invention, the moisture profile of the web in the z-direction, i.e., in the direction of the thickness of the web, is equalized by means of drying devices and/or by means of a moistening device. These drying devices may comprise, e.g., gas or electric infrared radiators. As the moistening devices, it is possible to use moist air and/or water steam blown against the free face of the web to be dried. It is also possible to use microwave dryers and radio-frequency RF-dryers as the drying devices which equalize the moisture in the direction of thickness. The drying and/or moistening devices mentioned above are preferably arranged in the area of the final end of the dryer section, where the dry solids content Ka of the web is greater than about 65%, preferably even greater than about 80%. These devices can be favorably connected with arrangements for the control of the transverse moisture profile of the web to provide a complete and integrated system.

In the present invention, by means of a combination of a number of process steps and solutions of construction that are partly known in themselves in the prior art, it has been possible to create a dryer section that is more advantageous both in respect of its construction and in respect of its runnability. Also, the paper produced by means of the dryer section has quality properties that meet even high requirements, e.g., with respect to the symmetry and dimensional stability of the paper.

In the following, the invention will be described in detail with reference to some exemplifying embodiments of the invention illustrated schematically in the figures in the accompanying drawings. However, the invention is by no means strictly confined to the details of these embodiments.

BRIEF DESCRIPTION OF THE DRAWINGS

The following drawings are illustrative of embodiments of the invention and are not meant to limit the scope of the invention as encompassed by the claims.

In FIG. 1, the press section and the initial part of the dryer section are shown in the upper part, and the final end of the dryer section is shown in the lower part underneath the upper part, and the section plane dividing the dryer section is denoted by A—A.

DETAILED DESCRIPTION OF THE INVENTION

Figure 1:
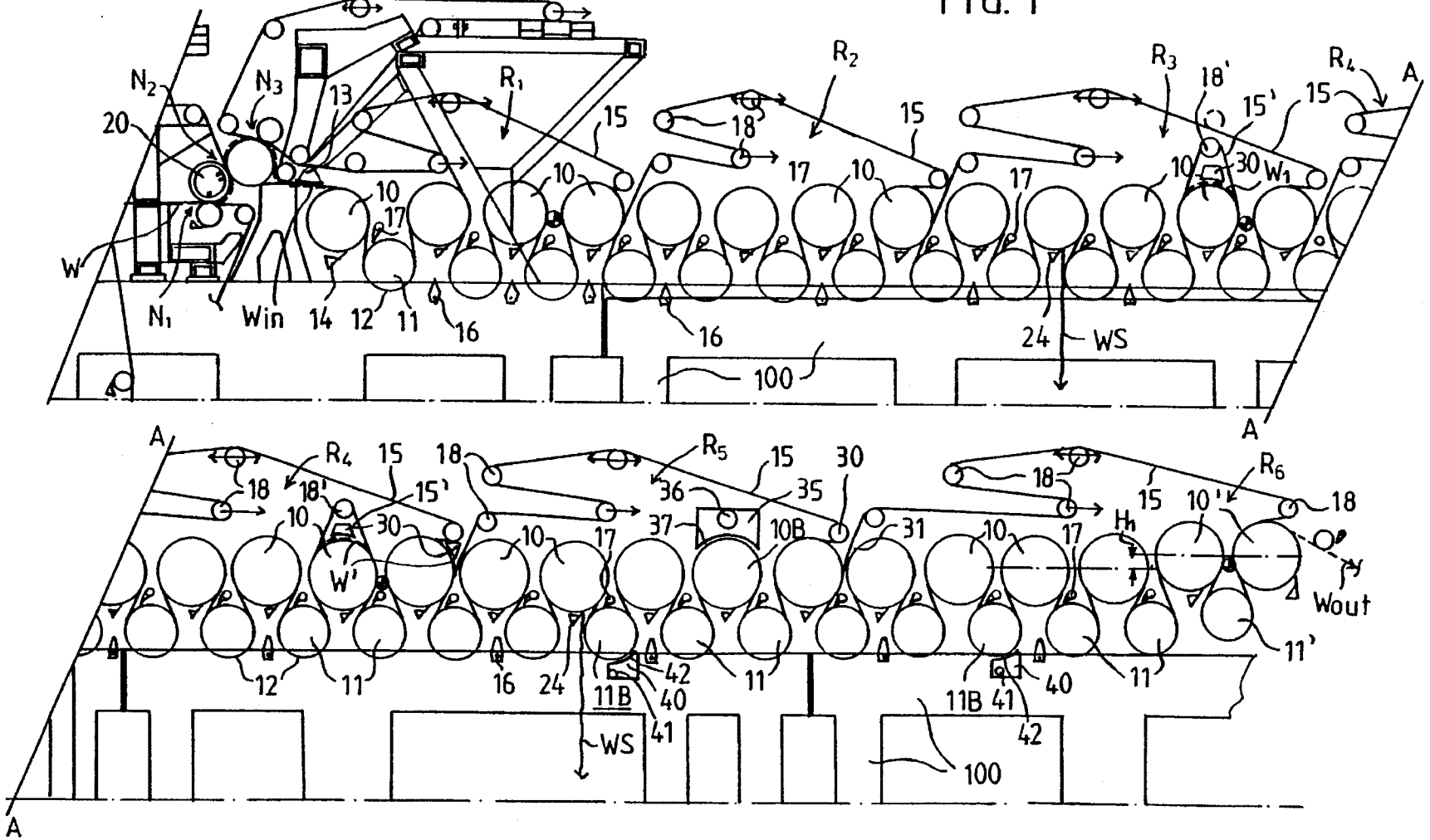
FIG. 1 is a schematic side view of a dryer section in accordance with the present invention.

Referring to the drawings, as shown in FIG. 1, a paper web $W_{in}$ is passed into the dryer section from a press section onto a drying wire 15 of a first dryer group $R_1$ with a single-wire draw. The web adheres to the drying wire 15 by the effect of negative pressure applied into and through suction boxes 13. FIG. 1 schematically shows the press section 20 which precedes the dryer section and in which the web W is dewatered by pressing it by means of three successive roll nips $N_1$,$N_2$ and $N_3$ before the web W is transferred onto the first group $R_1$ with single-wire draw in the dryer section. The dryer section comprises 6 dryer groups $R_1, \ldots, R_6$ each having a single-wire draw, and arranged in relation to one another so that the web has a closed draw in the group gaps defined between adjacent ones of the dryer groups. The dryer section in accordance with the invention comprises normal dryer groups $R_1, \ldots, R_N$, usually from about 4 to about 10 such dryer groups, preferably between about 5 and 7, and typically only 6 as shown.

Preferably, all the dryer groups $R_1, \ldots, R_N$ with a single-wire draw are so-called normal groups in which, e.g., steam-heated smooth-faced drying cylinders 10 are arranged in an upper horizontal row and reversing suction cylinders 11 are arranged in a lower horizontal row. In the last normal group $R_6$ in the running direction of the web, the last two upper cylinders 10', and last reversing suction cylinder 11', which is placed between the last two upper cylinders 10', are positioned at a different level than the remaining dryer section and dryer groups $R_1, \ldots, R_5$, i.e., are displaced by dimension $H_1$. The dimension $H_1$ is typically about 400 min. A frame part 100 of the dryer section is also illustrated only schematically in FIG. 1.

Each normal group $R_1, \ldots, R_N$ has a separate drying wire 15 of its own, which is guided by guide rolls 18. The drying wires 15 press the web W to be dried against the smooth heated faces of the drying cylinders 10. On the reversing cylinders 11, the web W remains on the outer face of the wire 15 at the side of the outside curve. However, on the reversing cylinders 11, the web W is held reliably on support of the wire 15 against the effect of centrifugal forces by the presence of the negative pressure present in grooved faces 12 of the reversing suction cylinders 11. This serves to prevent transverse shrinkage of the web W.

As the reversing suction cylinders 11, particularly favored suction cylinders are the suction cylinders marketed by the assignee under the trade mark "VAC-ROLL"™. These cylinders have no inside suction box and, in respect of the details of such cylinder constructions, reference is made to the assignee's Finnish Patent No. 83,680 (corresponding to U.S. Pat. No. 5,022,163).

In a preferred embodiment of the invention, the support contact between the web W and the drying web 15 is adequately maintained on the straight runs between the drying cylinders 10 and the reversing cylinders 11, at least on the runs taking place from the drying cylinders 10 to the reversing cylinders 11, by utilizing blow-suction boxes 17. These blow-suction boxes 17 serve to prevent the formation of pressures induced by the wire 15 in the closing wedge-shaped nip spaces between the wire 15 and the mantles of the cylinders 11. With respect to the details of the constructions of such blow-suction boxes 17, which are marketed by the assignee under the trade mark "UNO RUN BLOW BOX"™, reference is made to the assignee's Finnish Patent Nos. 59,637, 65,460, and 80,491 (corresponding to U.S. Pat. Nos. 4,441,263, 4,516,330 and 4,905,380, respectively, the specifications of which are hereby incorporated by reference herein).

After the introduction of the "UNO RUN BLOW BOX"™ in the marketplace, the assignee's competitors have also suggested some blow-box solutions, with respect to which reference is made to the U.S. Pat. Nos. 4,502,231 (assigned to J. M. Voith GmbH) and 4,661,198 (assigned to Betoit Corp.). The applications of these blow boxes in the positions of the blow boxes 17 are also included in the scope of the overall concept of the present invention.

In the dryer groups $R_1, \ldots, R_N$ with a single-wire draw, and possibly also in the gaps between the reversing cylinders 11, blow boxes 16 are arranged to air-conditioned the gap spaces and promote evaporation from the web W. The faces of the drying cylinders 10 are kept clean by doctors 14,24.

In the invention, it is a further important feature and advantage that, in the groups $R_1, \ldots, R_N$ with a single-wire draw, which extend across the entire length of the dryer section, removal of broke by gravity can be applied. This is because the dryer groups $R_1, \ldots, R_N$ with single-wire draw are open downwards so that the broke paper web WS can be removed without special arrangements onto a broke conveyor (not shown) placed in the basement space of the paper machine, the broke being carried on the broke conveyor further into a pulper or multiple pulpers.

In FIG. 1, the overall horizontal length of the dryer section in the machine direction is about 70 m when six normal groups $R_{1, \ldots, N}$ (N=6) are used. The number $N_1$ of drying cylinders 10 used in each of the individual normal groups $R_{1, \ldots, N}$ is in the range of from about 3 to about 8, preferably from about 4 to about 7.

In view of prevention of transverse shrinkage of the web W, it is of particular importance that the web W should be held in reliable contact with the drying wires 15 substantially all the time. This holding effect is achieved on the reversing cylinders 11 by means of the negative pressure present in the grooved mantles 12 of the outer faces of the reversing cylinders, and on the straight runs between the drying cylinders 10 and the reversing cylinders 11 by means of the pressure levels provided by means of the blow-suction boxes 17.

Figure 2:
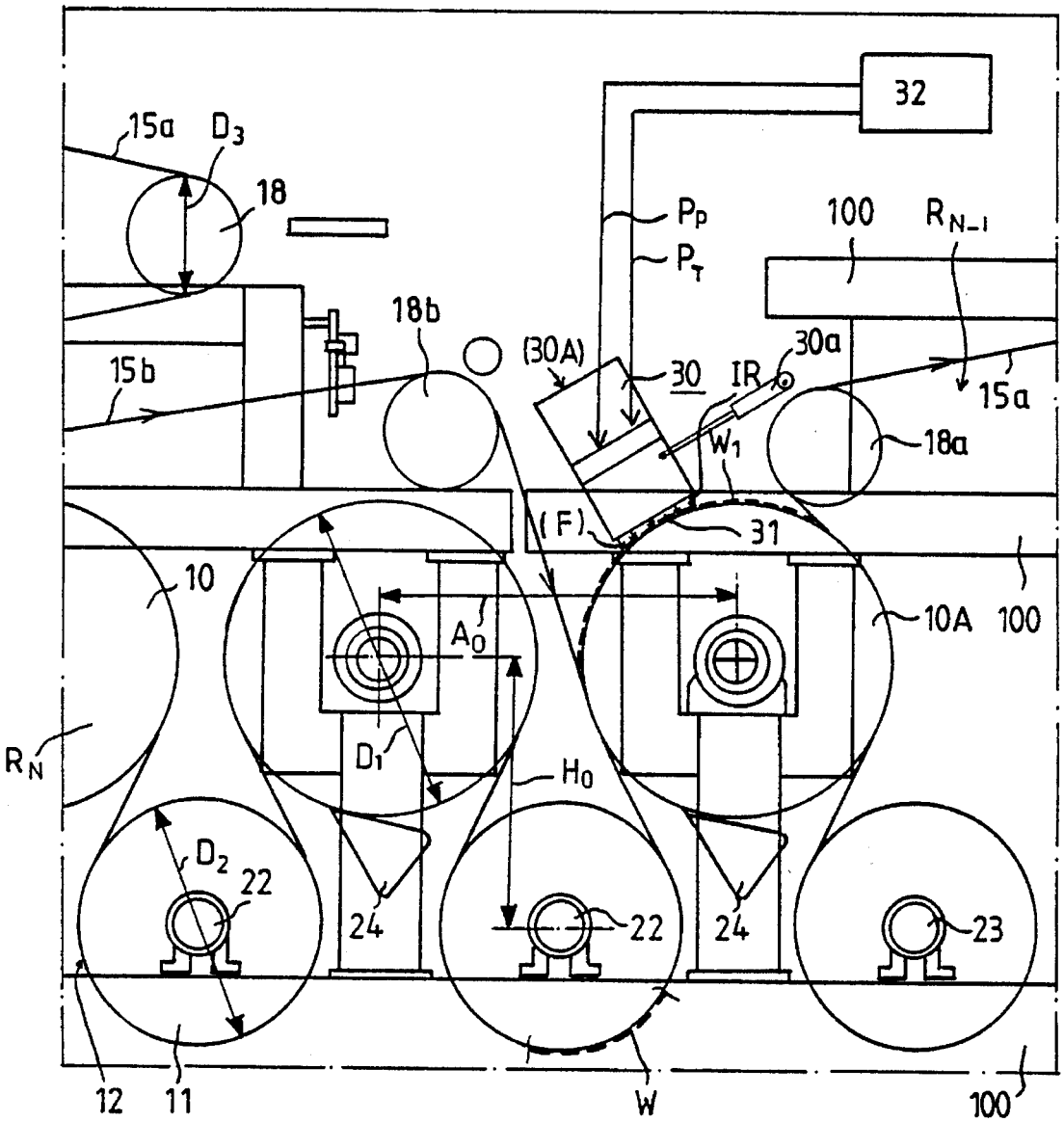
FIG. 2 illustrates a group-gap draw between two normal dryer groups, wherein an infrared dryer is employed on the first contact-drying sector in the latter one of the normal dryer groups.

Referring now to FIG. 2, an infrared radiation dryer 30 is arranged in accordance with the second embodiment of the invention. The dryer is placed between the last dryer group $R_N$ with a single-wire draw and the next to the last (penultimate) dryer group $R_{N-1}$ with a single-wire draw. The dryer 30 applies a field of infrared radiation IR in the area of the drying gap 31 to the upper face of the web W that is placed free on the face of the drying cylinder 10A, i.e. to the side of the web W that is opposite to the web face that is placed in contact with the drying cylinders 10, 10A or the exposed side of the web. The area $W_1$ of the web W that is free from the wire (when the web has an exposed side) is arranged by guiding the drying wires 15*a* and 15*b* by means of guide rolls 18*a* and 18*b* so that a free area $W_1$ of the web W is formed. However, a closed draw is still accomplished from the group $R_{N-1}$ to the next group $R_N$. The infrared radiator or dryer 30 ideally extends across the entire width of the web W. The infrared radiator 30 may operate either by electricity or gas-derived energy. Other arrangements for separating the drying wire from the upper face of the web are also anticipated to be within the scope of the invention.

In FIG. 2, the regulation means are shown schematically as a block 32. By means of the regulation means, both the power level PT Of the infrared radiation IR and its distribution $P_P$ in the transverse direction are regulated. By means of the distribution $P_P$ of the power, the transverse moisture profile of the web W is controlled.

It is an important feature of the operation of the infrared radiator 30 that it equalizes the moisture profile of the web W in the z-direction by applying a substantial impulse of drying energy to the upper face of the web W. IR-devices 30 can be placed in one or several group gaps $R_n$–$R_{n+1}$. In FIG. 1, it is illustrated schematically that IR-devices 30 have been placed in the group gaps between the last three dryer groups $R_4$, $R_5$ and $R_6$ and additionally inside the dryer groups $R_3$ and $R_4$.

Moreover, by means of the IR-devices 30, it is possible to increase the drying capacity of the dryer section so that the overall length of the dryer section can be shortened by a few drying cylinders. Any shortening of the length of the dryer section is of significant importance.

Instead of the IR-devices 30 described above, it is also possible to use corresponding microwave or RF-radiators. Instead of, or in addition to, such radiators 30, it is possible to use devices for blowing of drying air, by whose means drying-air jets are applied to the upper face of the web W in the free areas W1 of the paper web. This serves to intensify the evaporation of water from the web. In FIG. 2, reference numeral 30A in parentheses refers to these blow devices which apply air jets F to the upper face of the web W in the free area W1 of the web running over the cylinder 10A.

In addition to the locations in the group gaps, FIG. 1 shows dryers 30 placed inside the wire groups $R_3$ and $R_4$. These dryers are placed in such free areas W1 of the web W as have been provided by guiding the drying wire 15 apart from the drying cylinder 10 and from the web W by means of a certain guide roll 18'. The runs 15' of the drying wire 15 thus formed define a "pocket" in which the dryer 30 is placed to apply a drying effect to the upper face in the free area W1 of the web W.

In FIG. 2, a hydraulic cylinder **30*a* is shown schematically arranged in connection with the dryer 30,30A. By means of the hydraulic cylinder 32*a*, the dryer 30,30**A can be shifted further apart from the paper web W, e.g., during threading operations of the web W and/or in order to facilitate the removal of broke, which may be necessitated by a web break.

FIG. 1 shows an air-blow unit 35 arranged inside the loop of the wire 15 of the next to the last dryer group $R_5$. Air-blow unit 35 is spaced a distance apart from the drying cylinder 10B to define a blow gap or treatment gap 37 in relation to the adjacent drying cylinder 10B. Through air intake pipe 36 of the blow unit 35, dry and hot air is introduced into the unit 35 and is blown in the treatment gap 37 against the wire 15. The dry and hot air blowings ventilate the pores in the wire 15 and lower the component pressure of steam present in them, thereby intensifying the evaporation taking place from the upper face of the paper web W as it runs on the face of the cylinder 10B. In this manner, the moisture profile of the web W in the z-direction can be equalized and, moreover, the overall drying capacity of the paper machine can be increased. Blow units 35 may be arranged in connection with more than one of the dryer groups $R_N$, and one or several groups may also include more than one of the blow units 35.

FIG. 1 also shows moistening devices 40 arranged underneath the dryer groups $R_5$ and $R_6$. Moistening devices 40 are spaced apart from the adjacent cylinder to define a treatment gap 42 with the adjacent web W and with the reversing suction cylinder 11B. Moistening device 40 may be, for example, a steam box in itself known or a device that blows moist air and/or water mist, and serves to equalize the moisture profile of the web in the z-direction by blowing a moist medium onto the lower face of the web that has been dried in contact drying on the drying cylinders 10. By means of the moistening devices 40, it is also possible to equalize the transverse moisture profile of the web W and, if necessary, to relax the internal tensions in the web in accordance with the principles that are described, e.g., in the assignee's Finnish Patent Application No. 906216, and thereby to control the curling profile of the paper. There may be several such moistening devices 40 in different groups $R_N$, and preferably such devices are placed in the last group $R_N$ or in the last two groups $R_N$ or $R_{N-1}$.

Moistening devices 40 are preferably placed in the final end of the dryer section in an area in which the dry solids content Ka of the web is greater than about 65%, preferably in an area in which the dry solids content is greater than about 80%.

In view of the runnability of the web, the blow devices 17 mentioned above are also quite important. The blow devices are placed on the runs of the drying wire 15 and the web W passing from the drying cylinders 10 to the reversing suction cylinders. These boxes 17 are used preferably in the initial end of the dryer section only, when the dry solids content Ka of the web is less than about 70%.

The primary function of the dryers 30 and 35 described above is to equalize the moisture profile of the web in the z-direction by application of drying energy expressly from the side of the upper face of the web W, i.e. from the side opposite to the side that is in contact with the hot faces of the drying cylinders 10. However, it is a further advantage of the dryers 30 and 35 that by providing such dryers in the dryer section, it is possible to increase the drying capacity even to such an extent that the length of the dryer section can be reduced by about 5 m to about 8 m in comparison to a dryer section in which only contact-drying cylinders 10 are used.

In a preferred embodiment of the present invention, it is possible to apply so-called ropeless tail threading. Ropeless threading can be accomplished in the normal groups $R_1, \ldots, R_N$ on the drying wires 15 and on the reversing suction cylinders 11, as well as on the straight runs of the wires in connection therewith, by means of blow boxes 17 and by subjecting the reversing suction cylinders 11 to negative pressure. Further, in connection with the doctors 14,24, it is possible to install air-blow devices to ensure separation of the leader strip from the cylinder face 10 and its adhering to the drying wire 15.

As to the dimensioning of the various cylinders and rolls in the dryer section, it should be stated that advantageously the diameters $D_1$ of the drying cylinders 10 in the normal dryer groups $R_1, \ldots, R_N, R_S$ are selected to be less than about 2.5 m, preferably in the range from about 1.8 m to about 2.2 m. The diameter $D_2$ of the reversing suction cylinders 11 is selected to be about 0.5 m to about 2 m, preferably in the range of from about 1.0 m to about 1.5 m, and even more appropriately in the range of from about 1.2 m to about 1.5 m. The diameter range of $D_2$ between about 0.5 m and 1.2 m is usually employed in narrower paper machines only. FIG. 2 also shows the horizontal distance $A_o$ of the cylinders in a normal group $R_1, \ldots, R_N$ which is about 2100 mm, and the vertical distance $H_o$ between the cylinders 10, 11 which is about 1600 mm. The diameter $D_3$ of the guide rolls **18, 18*a*, 18*b*** is typically in the range of from about 400 mm to about 700 mm, depending on the width of the paper machine.

When the diameter $D_2$ of the reversing suction cylinders 11 is selected in the manner mentioned above, the centrifugal forces that attempt to separate the paper web W from the drying wire 15 on the turning sectors of the reversing suction rolls 11 can be made relatively low. As such, the paper web W can be kept reliably in contact with the drying wire 15 across the entire length and width of the dryer section with reasonable levels of negative pressure in the grooved face 12. In this manner, transverse and longitudinal shrinkage of the paper web W is prevented, and thus the properties of quality of the paper are substantially improved. The reversing suction cylinders 11 are preferably constructed without inside suction boxes. With the prerequisites given above, the negative pressure in the groove spaces 12 in the cylinder mantle of the reversing suction rolls 11 is preferably arranged to be in the range of from about 1 kPa to about 3 kPa.

Even though in the above-described embodiments of the invention, all the reversing suction cylinders 11 are large-diameter suction cylinders ($D_2$ being from about 800 mm to about 2000 mm) without any inside suction box and in which the suction zone extends across the entire outer circumference of the mantle, it should be emphasized that the scope of the invention also includes embodiments in which some of the reversing suction cylinders 11 have been substituted for by so-called normal small-diameter suction rolls. Such normal small-diameter suction rolls are provided with inside suction boxes and the diameter of these rolls is generally smaller than the above diameter $D_2$ of the reversing suction cylinders (typically only from about 500 mm to about 1200 mm). If these normal suction rolls, whose suction zone usually extends over the sector covered by the paper and the wire, are used, they are preferably placed in the initial end of the dryer section only.

One of the regulation parameters that can be utilized in the invention and by whose means the progress of the drying can be controlled is the tensions $T_N$ of the drying wires 15. In a preferred embodiment of the invention, $T_N$ is selected in the range of from about 1.5 kN/m to about 8 kN/m. Preferably, it is possible to use such an arrangement of tension of the drying wires 15 in which, in the groups $R_{1,\ldots,N}R_S$, the tension $T_N$ of the wires 15, 15S is increased constantly as the drying makes progress, i.e., in the running direction of the web, in accordance with the principles that are described in the assignee's Finnish Patent No. 83,441.

When the web W departs from the dryer section at $W_{out}$, its dry solids content $k_{out}$ is generally in the range of from about 92% to about 98%, whereas the dry solids content of the web W on its entrance into the dryer section ($k_{in}$) is about 40% to about 50%.

Figure 3:
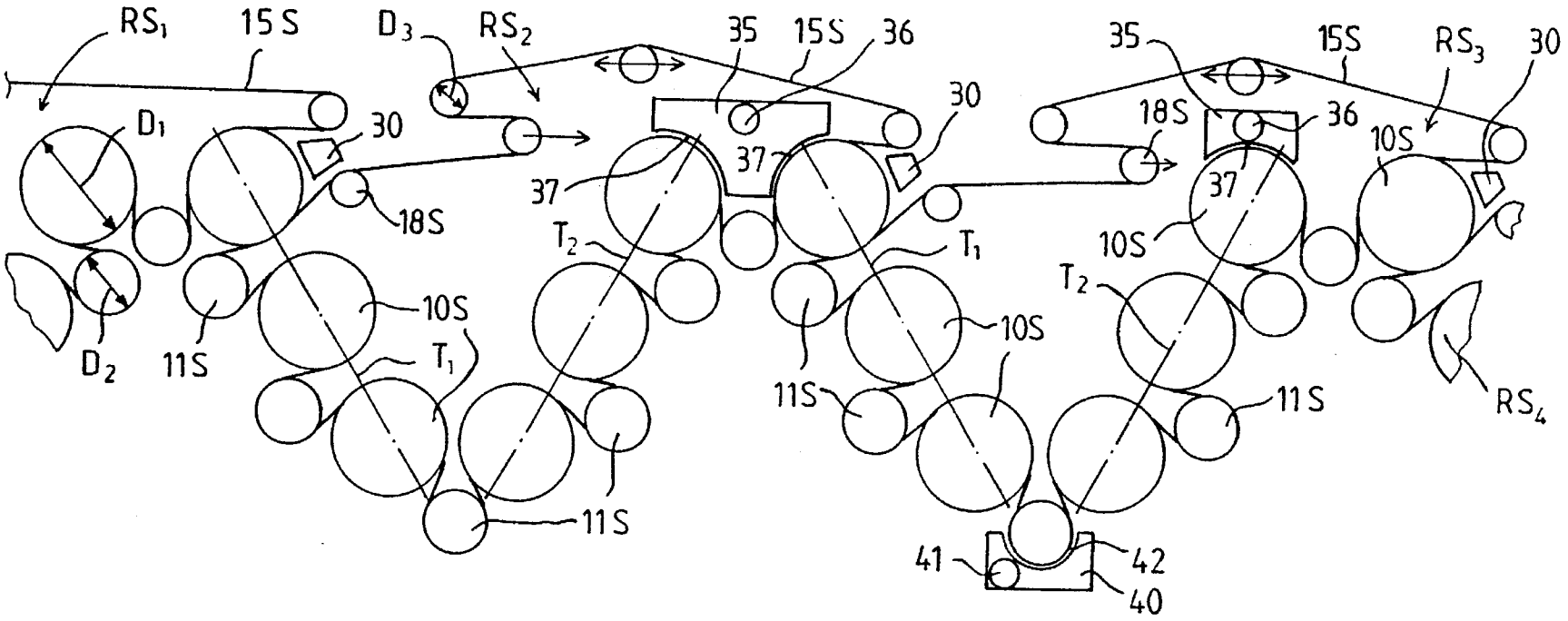
FIG. 3 shows a dryer section in accordance with the present invention in which the so-called normal dryer groups have been arranged as diagonal groups.

FIG. 3 shows a modification of the dryer section as shown in FIG. 1 in which all or some of the single-wire groups $R_{1,\ldots,N}$ have been substituted for by special groups $RS_1$,$RS_2$, $RS_3$, . . . etc. having a diagonal alignment of rolls. The first three contact-drying cylinders 10S in the direction of progress of the web W, are placed in a downward inclined plane $T_1$, and the next three corresponding drying cylinders 10S are arranged in an upward inclined plane $T_2$. In FIG. 3, the reversing cylinders in the groups $RS_1, \ldots, RS_3$ are denoted by reference 11S, the reversing rolls are denoted by reference 18S and the wires are denoted by reference 15S. The inclined groups may be preceded by normal single-wire groups $R_1, \ldots, R_N$ similar to those shown in FIG. 1, the web W preferably being passed in closed draws between the normal groups and the inclined groups $RS_{N-1}$ and $RS_N$.

Instead of the inclined groups or diagonal groups RS, it is also possible to use vertical or almost vertical cylinder groups in the dryer section. With respect to such vertical groups, reference is made to the assignee's Finnish Patent Nos. 53,333 and 82,097 (corresponding to U.S. Pat. Nos. 3,868,780 and 4,972,608, respectively, the specifications of which are hereby incorporated by reference herein) and to U.S. Pat. No. 5,177,880 assigned to J. M. Voith GmbH. The diagonal groups RS or the corresponding vertical groups, at least their lower portions, may extend to a level which is below the floor level of the paper machine hall and even into basement spaces of the paper machine hall.

The scope of the invention also includes embodiments in which the overall length of the dryer section has been shortened in respect of the groups $R_1, \ldots, R_N$ with a single-wire draw by arranging the drying cylinders 10 in two or more horizontal, vertical, or inclined planes in one or more of the dryer groups $R_1, \ldots, R_N$.

The examples provided above are not meant to be exclusive. Many other variations of the present invention would be obvious to those skilled in the art, and are contemplated to be within the scope of the appended claims.

We claim:

1. Dryer section in a paper machine, comprising a plurality of only normal dryer groups having a single-wire draw, each of said dryer groups comprising contact-drying cylinders arranged in a first horizontal row and reversing suction cylinders arranged in a second horizontal row spaced from and situated vertically below said first row of contact-drying cylinders, a paper web to be dried being passed in a closed draw between adjacent ones of said dryer groups and running over an outer circumference of said reversing suction cylinders while being subjected to negative pressure, said dryer section not including any inverted dryer groups having a single-wire draw in which contact-drying cylinders are arranged in one horizontal row and reversing suction cylinders are arranged in another horizontal row situated vertically above said row of contact-drying cylinders, and means for applying moisture to the web during a run of the web through one of said normal dryer groups to control and/or equalize a moisture profile of the web in a direction of thickness of the web, said reversing suction cylinders having a perforated and grooved outer mantle through which the negative pressure is applied to the web, said reversing suction cylinders having a diameter in the range from about 500 mm to about 2000 mm and lacking interior suction boxes.

2. The dryer section of claim 1, wherein said reversing suction cylinders have a diameter in the range from about 1000 mm to about 1600 mm.

3. The dryer section of claim 1, wherein at least one of said dryer groups comprises a normal suction roll having internal suction boxes and a diameter smaller than the diameter of said reversing suction cylinders.

4. The dryer section of claim 1, further comprising blow means arranged in proximity to said drying wire running over one of said contact-drying cylinders in at least one of said dryer groups and in opposed relationship to said one of said contact-drying cylinders in said at least one dryer group, a treatment gap being defined between said blow means and said drying wire as said drying wire runs over said one of said contact-drying cylinders in said at least one dryer group, said blow means applying a flow of drying air into pores in said drying wire to promote evaporation of water from the web.

5. The dryer section of claim 1, wherein said moisture applying means apply a liquid-containing medium to the web, said medium comprising moist air and/or water mist.

6. The dryer section of claim 1, further comprising means for supplying a moist medium to the web to control and equalize the moisture profile of the paper web in a cross-machine direction transverse to a running direction of the web, said moist medium comprising moist air and/or water mist.

7. The dryer section of claim 1, wherein said moisture applying means apply a liquid-containing medium to the web to control and equalize the moisture profile of the paper web also in a cross-machine direction transverse to a running direction of the web, said moist medium comprising moist air and/or water mist, and an actuator for shifting said moisture applying means in relation to the web to enable tail threading and/or facilitate removal of broke.

8. Dryer section in a paper machine, comprising a plurality of only normal dryer groups having a single-wire draw, each of said dryer groups comprising contact-drying cylinders arranged in a first row, reversing suction cylinders arranged in a second row spaced from said first row of contact-drying cylinders and a drying wire for supporting a paper web, the paper web being passed in a closed draw between adjacent ones of said dryer groups and running over an outer circumference of said reversing suction cylinders while being subjected to negative pressure, the web running over a sector of at least one of said contact-drying cylinders in one of said dryer groups and having an exposed first face and a second, opposed face of the web in direct contact with an outer surface of said at least one of said contact-drying cylinders in said sector, and drying means for applying a drying impulse to the exposed first face of the web as the web runs over said sector of said at least one contact-drying cylinder such that the drying profile of the web in the direction of thickness of the web is equalized and the drying capacity of the dryer section is increased.

9. The dryer section of claim 8, wherein said drying means are selected from the group consisting of radiation-drying devices and drying-gas blowing devices.

10. The dryer section of claim 8, further comprising means for exposing the first face of the web in said sector, said web exposing means comprising separating means for separating said drying wire from the first face of the web in proximity to a gap between adjacent ones of said dryer groups.

11. The dryer section of claim 8, further comprising means for exposing the first face of the web in said sector, said web exposing means comprising separating means for separating said drying wire from the first face of the web inside at least one of said dryer groups, said separating means comprising a guide roll, said drying wire being separated from the first face of the web at a first location as the web runs over said at least one of said contact-drying cylinders, running around said guide roll and recontacting the first face of the web running over said at least one of said drying cylinders at a second location, said drying means being arranged to apply the drying impulse to the exposed first face of the web between the first and second locations.

12. The dryer section of claim 8, further comprising blow means arranged in proximity to said drying wire running over one of said contact-drying cylinders in at least one of said dryer groups and in opposed relationship to said one of said contact-drying cylinders in said at least one dryer group, a treatment gap being defined between said blow means and said drying wire as said drying wire runs over said one of said contact-drying cylinders in said at least one dryer group, said blow means applying a flow of drying air into pores in said drying wire to promote evaporation of water from the web.

13. The dryer section of claim 8, further comprising means for supplying a moist medium to the web to equalize the moisture profile of the paper web in the direction of thickness of the web, said moist medium comprising moist air and/or water mist.

14. The dryer section of claim 8, further comprising means for supplying a moist medium to the web to control and equalize the moisture profile of the paper web in a direction transverse to the running direction of the web, said moist medium comprising moist air and/or water mist.

15. The dryer section of claim 8, further comprising an actuator for shifting said drying means in relation to the web to enable tail threading and/or facilitate removal of broke.

16. The dryer section of claim 8, wherein said plurality of normal groups are structured and arranged such that said second face of the web is carried by a respective one of said drying wires into direct contact with respective ones of said contact-drying cylinders whereby the web is dried through its second face by direct contact with outer surfaces of said contact-drying cylinders and through its first face by the application of the drying impulse by said drying means.

17. Dryer section in a paper machine, comprising a plurality of only normal dryer groups having a single-wire draw, each of said dryer groups comprising contact-drying cylinders arranged in a first row and reversing suction cylinders arranged in a second row spaced from said first row of contact-drying cylinders, a paper web to be dried being passed in a closed draw between adjacent ones of said dryer groups and running over an outer circumference of said reversing suction cylinders while being subjected to negative pressure, said first and second rows being horizontal, diagonal or vertical rows, first supply means for supplying a moist medium to the web to control and/or equalize a moisture profile of the web in a cross-machine direction transverse to the running direction of the web, said moist medium comprising moist air and/or water mist, said reversing suction cylinders having a perforated and grooved outer mantle through which the negative pressure is applied to the web, said reversing cylinders having a diameter in the range from about 500 mm to about 2000 mm.

18. The dryer section of claim 17, wherein said reversing suction cylinders have a diameter in the range from about 1000 mm to about 1600 mm and lacking interior suction boxes.

19. The dryer section of claim 17, wherein at least one of said dryer groups comprises a normal suction roll having internal suction boxes and a diameter smaller than the diameter of said reversing suction cylinders.

20. The dryer section of claim 17, further comprising blow means arranged in proximity to said drying wire running over one of said contact-drying cylinders in at least one of said dryer groups, a treatment gap being defined between said blow means and said drying wire, said blow means applying a flow of drying air into pores in said drying wire to promote evaporation of water from the web.

21. The dryer section of claim 17, further comprising second supply means for supplying a moist medium to the web to control and/or equalize the moisture profile of the paper web in the direction of thickness of the web, said moist medium comprising moist air and/or water mist.

22. The dryer section of claim 17, further comprising an actuator for shifting said first supply means in relation to the web to enable tail threading and/or facilitate removal of broke.

23. Dryer section in a paper machine, comprising a plurality of only normal dryer groups having a single-wire draw, each of said dryer groups comprising contact-drying cylinders arranged in a first row and reversing suction cylinders arranged in a second row spaced from said first row of contact-drying cylinders, a paper web to be dried being passed in a closed draw between adjacent ones of said dryer groups and running over an outer circumference of said reversing suction cylinders while being subjected to negative pressure, said first and second rows being horizontal, diagonal or vertical rows, first supply means for supplying a moist medium to the web to control and equalize a moisture profile of the web in the direction of thickness of the web, said moist medium comprising moist air and/or water mist, and actuator means for shifting said first supply means and/or said drying means in relation to the web to vary the distance between said first supply means and the web and/or said drying means and the web, said reversing suction cylinders having a perforated and grooved outer mantle through which the negative pressure is applied to the web, said reversing cylinders or suction rolls having a diameter in the range from about 500 mm to about 2000 mm and lacking interior suction boxes.

24. The dryer section of claim 23, further comprising blow means arranged in proximity to said drying wire running over one of said contact-drying cylinders in at least one of said dryer groups, a treatment gap being defined between said blow means and said drying wire, said blow means applying a flow of drying air into pores in said drying wire to promote evaporation of water from the web.

25. The dryer section of claim 23, further comprising second supply means for supplying a moist medium to the web to control and/or equalize a moisture profile of the web in a cross-machine direction transverse to a running direction of the web, said moist medium comprising moist air and/or water mist.

26. Dryer section in a paper machine, comprising a plurality of only normal dryer groups having a single-wire draw, each of said dryer groups comprising contact-drying cylinders arranged in a first row, reversing suction cylinders arranged in a second row spaced from said first row of contact-drying cylinders and a drying wire for supporting a paper web, the web being passed in a closed draw between adjacent ones of said dryer groups and running over an outer circumference of said reversing suction cylinders while being subjected to negative pressure, said first and second rows being horizontal, diagonal or vertical rows, the web running over a sector of at least one of said contact-drying cylinders in one of said dryer groups and having an exposed upper face and an opposed lower face of the web in direct contact with an outer surface of said at least one of said contact-drying cylinders in said sector, and drying means for applying a drying impulse to the web at its upper face such that the drying profile of the web in the direction of thickness of the web is equalized and the drying capacity of the dryer section is increased, said drying means being arranged in connection with the upper face of the web and being selected from the group consisting of radiation-drying devices and drying-gas blowing devices.

27. The dryer section of claim 26, wherein said first row of contact-drying cylinders and said second row of reversing suction cylinders are substantially horizontal.

28. The dryer section of claim 26, further comprising means for exposing the upper face of the web in said sector, said web exposing means comprising separating means for separating said drying wire from the upper face of the web in proximity to a gap between adjacent ones of said dryer groups.

29. The dryer section of claim 26, further comprising means for exposing the upper face of the web in said sector, said web exposing means comprising separating means for separating said drying wire from the upper face of the web inside at least one of said dryer groups, said separating means comprising a guide roll, said drying wire being separated from the upper face of the web at a first location as the web runs over said at least one of said contact-drying cylinders, running around said guide roll and recontacting the upper face of the web running over said at least one of said drying cylinders at a second location, said drying means being arranged to apply the drying impulse to the exposed upper face of the web between the first and second locations.

30. The dryer section of claim 26, further comprising blow means arranged in proximity to said drying wire running over one of said contact-drying cylinders in at least one of said dryer groups and in opposed relationship to said one of said contact-drying cylinders in said at least one dryer group, a treatment gap being defined between said blow means and said drying wire as it runs over said one of said contact-drying cylinders in said at least one dryer group, said blow means applying a flow of drying air into pores in said drying wire to promote evaporation of water from the web.

31. The dryer section of claim 26, further comprising supply means for supplying a moist medium to the web to control and/or equalize a moisture profile of the web in the direction of thickness of the web, said moist medium comprising moist air and/or water mist.

32. The dryer section of claim 26, further comprising supply means for supplying a moist medium to the web to control and/or equalize a moisture profile of the web in a cross-machine direction transverse to a running direction of the web, said moist medium comprising moist air and/or water mist.

33. The dryer section of claim 26, further comprising actuator means for shifting said drying means in relation to the web to enable tail threading and/or facilitate removal of broke.

34. Dryer section in a paper machine, comprising a plurality of only normal dryer groups having a single-wire draw, each of said dryer groups comprising contact-drying cylinders arranged in a first row, reversing suction cylinders arranged in a second row spaced from said first row of contact-drying cylinders and a drying wire for supporting a paper web, the web being passed in a closed draw between adjacent ones of said dryer groups and running over an outer circumference of said reversing suction cylinders while being subjected to negative pressure, said first and second rows being horizontal, diagonal or vertical rows, the web running over a sector of at least one of said contact-drying cylinders in one of said dryer groups and having an exposed upper face and an opposed lower face of the web in direct contact with an outer surface of said at least one of said contact-drying cylinders in said sector, and drying means for applying a drying impulse to the web at its upper face such that the drying profile of the web in the direction of thickness of the web is equalized and the drying capacity of the dryer section is increased, said drying means being arranged in connection with the upper face of the web, and means for supplying a moist medium to the web to control and/or equalize a moisture profile of the paper web in a cross-machine direction transverse to a running direction of the web, said moist medium comprising moist air and/or water mist.

35. Dryer section in a paper machine, comprising a plurality of only normal dryer groups having a single-wire draw, each of said dryer groups comprising contact-drying cylinders arranged in a first row, reversing suction cylinders arranged in a second row spaced from said first row of contact-drying cylinders and a drying wire for supporting a paper web through said dryer group, the paper web being passed in a closed draw between adjacent ones of said dryer groups and running over an outer circumference of said reversing suction cylinders while being subjected to negative pressure, said first and second rows being horizontal, diagonal or vertical rows, the web running over a sector of at least one of said contact-drying cylinders in one of said dryer groups and having an exposed upper face and an opposed lower face of the web in direct contact with an outer surface of said at least one of said contact-drying cylinders in said sector, drying means for applying a drying impulse to the web at its upper face such that the drying profile of the web in a direction of thickness of the web is controlled and/or equalized and the drying capacity of the dryer section is increased, said drying means being arranged in connection with the upper face of the web, and actuator means for shifting said drying means in relation to the web to vary a distance between said drying means and the web and thereby enable tail threading and/or facilitate removal of broke.

* * * * *